United States Patent [19]

Kobayashi et al.

[11] Patent Number: 5,032,060

[45] Date of Patent: Jul. 16, 1991

[54] CONTINUOUSLY VARIABLE CAPACITY SWASH PLATE TYPE REFRIGERANT COMPRESSOR

[75] Inventors: Hisao Kobayashi; Masahiro Kawaguchi; Eiki Abe; Yoshitami Kondo, all of Kariya, Japan

[73] Assignee: Kabushiki Kaisha Toyoda Jidoshokki Seisakusho, Kariya, Japan

[21] Appl. No.: 601,884

[22] Filed: Oct. 22, 1990

[30] Foreign Application Priority Data

Nov. 2, 1989 [JP] Japan ..... 1-286630

[51] Int. Cl.[5] ..... F04B 1/26

[52] U.S. Cl. ..... 417/222 R; 417/222.5; 417/269

[58] Field of Search ..... 417/222, 222.5, 269, 417/270, 271; 92/71, 12.2

[56] References Cited

U.S. PATENT DOCUMENTS

| | | | |
|---|---|---|---|
| 4,778,348 | 10/1988 | Kikuchi et al. | 417/222 S |
| 4,801,248 | 11/1989 | Tojo et al. | 417/222 R |
| 4,863,356 | 9/1989 | Ikeda et al. | 417/269 |
| 4,886,423 | 12/1989 | Iwanami et al. | 417/222 S |
| 4,932,843 | 6/1990 | Itoigawa et al. | 417/222 R |

*Primary Examiner*—Leonard E. Smith
*Assistant Examiner*—Alfred Basichas
*Attorney, Agent, or Firm*—Brooks Haidt Haffner & Delahunty

[57] ABSTRACT

A continuously variable capacity swash plate type refrigerant compressor having a cylinder block defining therein a plurality of front and rear cylinder bores arranged around an axis of rotation of a drive shaft supported in the cylinder block, front and rear refrigerant suction chambers in front and rear housings attached to the ends of the cylinder block, an angularly inclined swash plate mounted on the drive shaft to be integrally rotated therewith and to be pivotable about a pivoting center to change an angle of inclination thereof, double-headed pistons reciprocated in the front and rear cylinder bores by the rotation of the swash plate in such a manner that the top dead center of the pistons in the rear cylinder bores is constantly set at a fixed position, front and rear suction passageways to suck the refrigerant before compression into the front and rear suction chambers, and a suction reducer for reducing a suction of the refrigerant gas by the rear suction passageway during the small capacity operation of the compressor to thereby generate a pressure differential between the front and rear suction chamber and obtain a flow of the lubricant contained refrigerant gas from the front suction chamber toward the rear suction chamber, while lubricating movable elements at the front side of the compressor.

5 Claims, 5 Drawing Sheets

CONTINUOUSLY VARIABLE CAPACITY SWASH PLATE TYPE REFRIGERANT COMPRESSOR

BACKGROUND OF THE INVENTION

1. Field of the Invention

The present invention relates to a continuously variable capacity swash plate type compressor having a plurality of double-headed compressing pistons reciprocating in front and rear cylinder bores of a cylinder block.

2. Description of the Related Art

A typical continuously variable capacity swash plate type compressor is disclosed in Japanese Unexamined (Kokai) Patent Publication No. 1-138382, and is shown in the accompanying FIG. 5. The compressor of FIG. 5 includes an axial cylinder block 51 having a plurality of axially extending cylinder bores 52 therein, a plurality of double-headed pistons 53 reciprocating in the cylinder bores 52, and a drive shaft 54 rotatably supported by the cylinder block 51 in such a manner that the axis of rotation of the drive shaft 54 is in parallel with the cylinder bores 52. The drive shaft 54 is provided with a slide or guide bush 55 slidably mounted thereon. The slide 55 has a spherical supporting portion 54*a* on which a swash plate 57 is rotatably mounted at a spherical recessed portion 57*a* thereof in such a manner that a peripheral portion of the swash plate 57 is engaged with the double-headed pistons 53 via shoes 56, respectively. The swash plate 57 is provided with a front connecting portion 57*b* connected to a front half portion 54*a* of the drive shaft 54 via a connecting pin 58 movably fitted in guide bores 54*b* formed in the front half portion 54*a*. The swash plate 57 is capable of being moved to change an inclination thereof with respect to a plane vertical to the axis of the drive shaft 54 about a center "C" existing at the peripheral portion of the swash plate 57, in response to a sliding movement of the slide 55 on the drive shaft 54, and thus one of the heads of each double-headed piston 53 is able to constantly reach a predetermined position in the corresponding cylinder bore 52, at a top dead center thereof during a compression stroke of the piston 53. Accordingly, even if the compressor is operated at a small capacity condition where the angle of inclination of the swash plate 57 is substantially zero with respect to the plane vertical to the axis of the drive shaft 54, a compression of a refrigerant gas and a discharge of the compressed gas are ensured.

In the conventional compressor of FIG. 5, the angle of inclination of the swash plate 57 is changed and controlled by a pressing force acting on the swash plate 57, due to a total pressure prevailing in the plurality of front and rear side cylinder bores 52, and a counter force acting on the swash plate 57 via a slidable controller 60, due to a pressure prevailing in a control chamber 59, which is connected to either a discharge pressure region of the compressor or a suction pressure region of the compressor and in which the volume thereof is changed by the slidable controller 60 slidable on the drive shaft 54.

The compression of the refrigerant gas is achieved by the reciprocation of the double-headed pistons 53 in the front and rear side cylinder bores 52, due to a wobbling of the inclinable variable swash plate 57 when the drive shaft 54 is rotated. During the compressing motion of the pistons 53, the swash plate 57 is subjected to a moment shown by an arrow M in FIG. 5, due to the pressure generated in the front and rear cylinder bores 52, and accordingly, the connecting pin 58 is pressed against the inner wall of the guide bores 54*b* to generate an axial force component which forcibly moves the drive shaft 54 forward, i.e., to the left in FIG. 5. Therefore, when the drive shaft 54 is forcibly moved, a reactive force is generated to press the slide 55 rearward, via the swash plate 57, and thus the angle of inclination of the swash plate 57, and accordingly the compressor capacity, is determined to establish a balanced condition between the above-mentioned reactive force and the pressure prevailing in the control chamber 59. Namely, by adjustably changing the pressure in the control chamber 59, the angle of inclination of the swash plate is changed to vary the compressor capacity.

Nevertheless, in the continuously variable capacity swash plate compressor as shown in FIG. 5, when a relationship between the displacement of the controller 60 and the pressure level in the control chamber 59 is graphically designated in an abscissa vs ordinate coordinate system, the relationship is illustrated by a curve as shown in FIG. 6. The curve of FIG. 6 indicates that, in the region of a small compressor capacity, i.e., in the region where an amount of movement of the slidable controller 60 is large, a force acting to press the slide 55 rearward and a counter pressure in the control chamber 59 acting to press the slide 55 forward, which are balanced with one another, are reduced to a very small level, and accordingly, the slide 55 is moved forward, i.e., in a direction which increases the compressor capacity, by an inertial force of the double-headed pistons 53 during a high speed rotation of the drive shaft 54. Namely, the compressor capacity is varied regardless of a change in a cooling load of the compressor or under the influence of a large change in the suction pressure of the refrigerant. Further, since the pressure in the control chamber 59 is maintained at a small pressure level, the slide 55 and the controller 60 cannot be smoothly moved in response to a change in the pressure in the control chamber 59, due to friction, and therefore, the compressor capacity cannot be smoothly varied.

In addition, in the front side cylinder bores 52 of the compressor, when the stroke of the double-headed pistons 53 is decreased, a volume in each front side cylinder bore 52 which is not fully compressed by the piston 53 increases, and accordingly, before the stroke of the pistons 53 is decreased to substantially a zero stroke, a state appears wherein a compression and discharge of the refrigerant is not carried out. More specifically, when the compressor is operated at a capacity of less than 30 through 40% of the full compressor capacity, no compression and discharge of the refrigerant occurs in the front side cylinder bores 52, i.e., the front side cylinder bores 52 remain in an operatively dormant state. When such a dormant state of the front side cylinder bores 52 occurs, a flow of the refrigerant from a swash plate chamber 61 toward the front side suction chamber disappears, and therefore, a thrust bearing 62, a radial bearing 63, and a lip seal 64 arranged on the front side of the compressor are not properly lubricated by the flowing refrigerant gas, and a lubricant oil soluble in the refrigerant gas, during the operation of the compressor at a small capacity.

SUMMARY OF THE INVENTION

Therefore, an object of the present invention is to provide a continuously variable capacity swash plate type compressor capable of obviating the defects encountered by the conventional compressor.

Another object of the present invention is to provide a continuously variable capacity swash plate type compressor provided with a control means for enabling a minute control of a compressor capacity even while the compressor is operated in a small capacity range, and a lubricating arrangement for lubricating movable. elements of a front side of the compressor during an operation in the small capacity range.

Therefore, in accordance with the present invention, there is provided a continuously variable capacity swash plate type compressor which comprises:

an axially extended cylinder block having front and rear ends thereof;

front and rear housings sealingly attached to the front and rear ends of the cylinder block and provided with front and rear suction chambers for the refrigerant before compression and front and rear discharge chambers for the refrigerant gas after compression;

a plurality of front and rear axial cylinder bores defined in front and rear portions of the axially extended cylinder block;

a plurality of double-heated pistons capable of axially reciprocating in the plurality of front and rear cylinder bores of the cylinder block, to thereby compress the refrigerant gas;

an axial drive shaft rotatably supported in the cylinder block and having an axis of rotation thereof extending axially in the cylinder block;

a swash plate supported on the drive shaft to be integrally rotated with the drive shaft, to thereby reciprocate the double-headed pistons at front and rear parallel faces thereof, and shoes, the swash plate being pivotable to change an angle of inclination with respect to a plane vertical to the axis of rotation of the drive shaft about a center located at a peripheral portion of the swash plate which passes through each of the rear cylinder bores during rotation of the swash plate, to thereby reciprocate each of the plurality of double-headed pistons in such a manner that a top dead center of each of the plurality of double-headed pistons is always located at a fixed position within each of the plurality of rear cylinder bores;

a control unit for controlling the angle of inclination of the swash plate to thereby adjustably vary the compressing capacity of the compressor depending on a change in a cooling load in the refrigerating circuit;

front suction passageway means arranged in the cylinder block for permitting a suction of the refrigerant gas before compression from the external refrigerating circuit into the front suction chamber;

rear suction passageway means arranged in the cylinder block for permitting a suction of the refrigerant gas before compression from the external refrigerating circuit into the rear suction chamber;

fluid passageway means for communicating between the front and rear suction chamber; and a suction reducer unit for reducing a flow of the refrigerant gas before compression passing through the rear suction passageway while the compressor is in operation at a small compressing capacity and the front cylinder bores are dormant, due to a lessening of the angle of inclination of the swash plate, the suction reducer means being operable in association with a change in the compressing capacity of the compressor.

In the variable capacity compressor according to the present invention, when the compressor capacity is reduced to a state where a compressing operation in the front side cylinder bores of the compressor becomes inactive and dormant, the suction reducer unit is operated to reduce a fluid communication between the swash plate chamber and the rear suction chamber through the rear suction passageway, to thereby lower a pressure in the rear suction chamber to a level less than the levels of pressures prevailing in the swash plate chamber and the front suction chamber. Therefore, an average pressure of the pressures in the respective rear cylinder bores is lowered, and a force pressing the slide controller in the control chamber toward the rear side of the compressor via the swash plate is made larger. Accordingly, a control pressure in the control chamber necessary for moving the slide controller during the small capacity operation of the compressor is increased, and therefore, a control of the movement of the slide controller by the control pressure is not adversely affected by external factors such as a change in the suction pressure of the refrigerant and a change in the number of rotations of the compressor. Namely, the slide controller can be smoothly moved to thereby smoothly vary the compressor capacity.

Further, as a pressure difference between the front and rear suction chambers is generated during the small capacity operation of the compressor, a flow of the refrigerant gas containing a lubricant oil therein moves from the swash plate chamber toward the rear suction chamber while passing through the front suction chamber, and thus a fluid passageway connecting the front and rear suction chambers is obtained to thereby obtain a constant lubrication of the movable elements arranged on the front side of the compressor.

BRIEF DESCRIPTION OF THE DRAWINGS

The above and other objects, features and advantages of the present invention will be made more apparent from the ensuing description of the embodiments with reference to the accompanying drawings, wherein.

DESCRIPTION OF THE PREFERRED EMBODIMENTS

Figure 1:
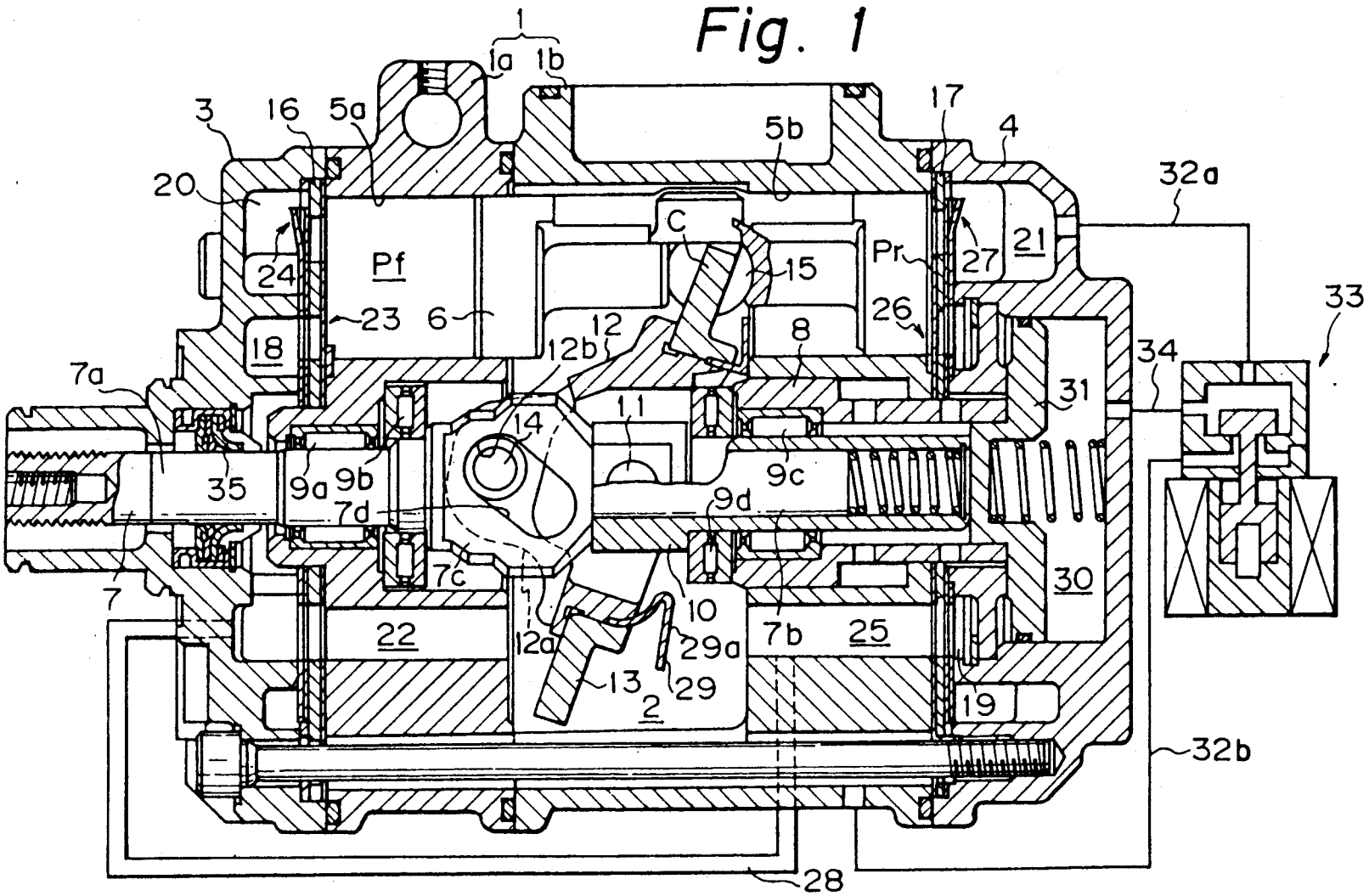
FIG. 1 is a longitudinal cross-sectional view of a continuously variable capacity swash plate type compressor according to an embodiment of the present invention, illustrating a state wherein the compressor is operating at a large compressing capacity.
Figure 2:
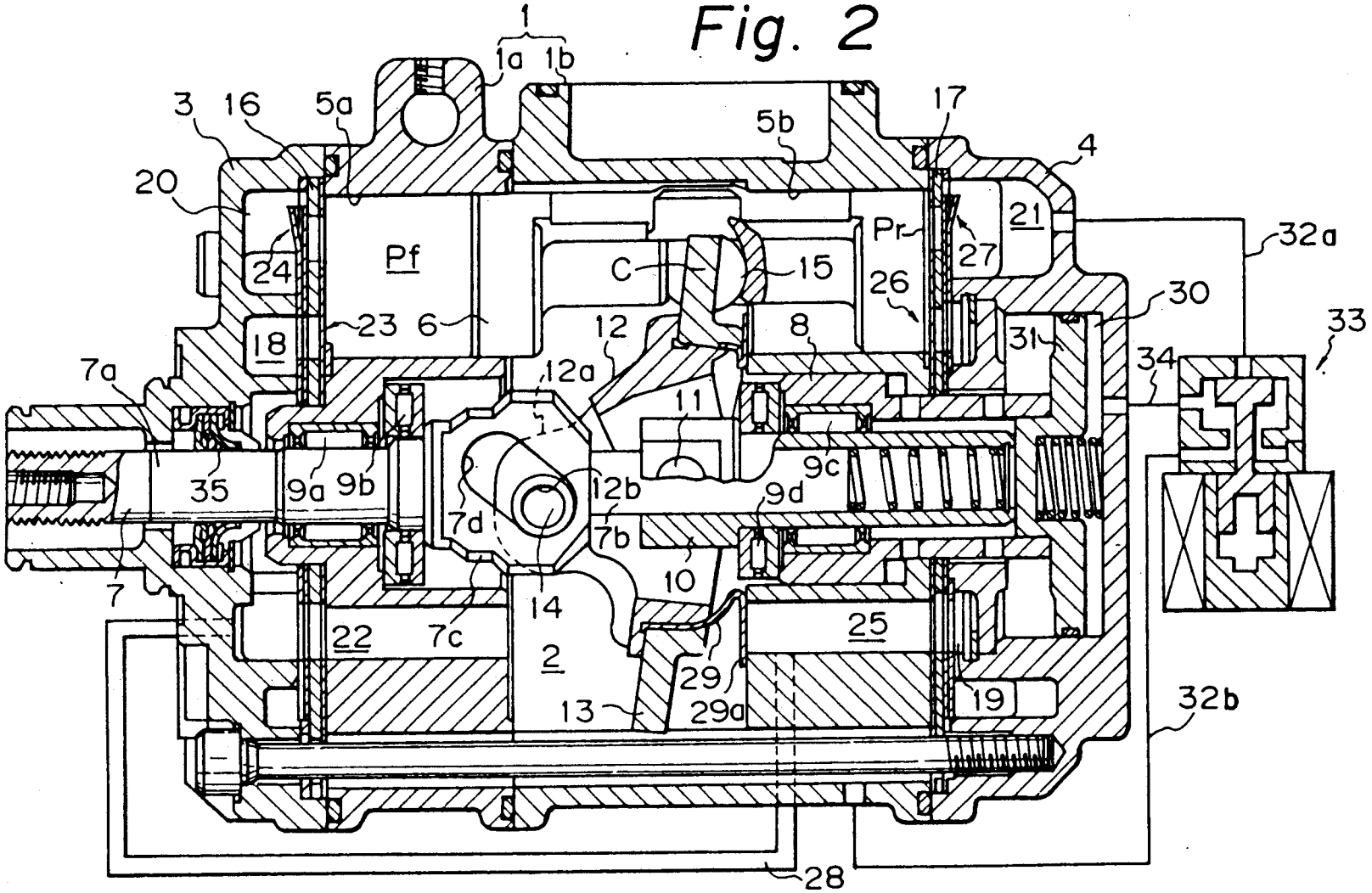
FIG. 2 is a longitudinal cross-sectional view of the compressor of FIG. 1, illustrating a state wherein the compressor is operating at a small compressing capacity.

Referring to FIGS. 1 and 2, the continuously variable capacity swash plate type compressor according to an embodiment of the present invention is provided with an axial cylinder block 1 having a front cylinder block 1*a* and a rear cylinder block 1*b* axially sealingly combined together. The cylinder block 1 having a swash plate chamber 2 in an axially central portion thereof is sealingly tightly closed by front and rear housings 3 and 4 at front and rear ends thereof. The cylinder block 1 has a plurality of front cylinder bores 5*a*, and a plurality of rear cylinder bores 5*b*, which are arranged to be in an axial alignment with one another while defining the above-mentioned central swash plate chamber 2 therebetween, in fluid communication with the front and rear cylinder bores 5*a* and 5*b*. A plurality of double-headed pistons 6 are slidably fitted in the front and rear cylinder bores 5*a* and 5*b* and are capable of being reciprocated therein. An axial drive shaft 7 having a front shaft portion 7*a*, a rear shaft portion 7*b*, and a flattened connecting portion 7*c* is rotatably supported in the cylinder block 1, and arranged to be extended in parallel with the axial front and rear cylinder bores 5*a* and 5*b*. The flattened connecting portion 7*c* of the drive shaft 7 is provided with a guide aperture 7*d* formed therein in the shape of an opening elongated in a direction slanted with respect to the axis of the drive shaft 7. In the rear cylinder block 1*b*, a cylindrical mover 8 is mounted around the drive shaft 7 to be axially moved along the rear shaft portion 7*b*. The front shaft portion 7*a* of the drive shaft 7 is supported in the front cylinder block 1*a* via a radial bearing 9*a* and a thrust bearing 9*b*, and the rear shaft portion 7*b* is slidably fitted in a cylindrical shouldered slide 10 rotatably supported by the above-mentioned cylindrical mover 8, via a radial bearing 9*c* housed in the mover 8. A thrust bearing 9*d* is arranged between the innermost end of the cylindrical mover 8 and a shoulder of the cylindrical slide 10. An inner large diameter portion of the shouldered slide 10 is extended into the swash plate chamber 2, and is provided with a pair of trunnion pins 11 radially projecting from diametrically opposed sides of the large diameter portion, in a direction vertical to the axis of the rear shaft portion 7*b* of the drive shaft 7. The trunnion pins 11 of the cylindrical slide 10 support a swash plate support 12 which is pivoted thereabout with respect to the slide 10 in the swash plate chamber 2. The swash plate support 12 has an outer periphery thereof formed with a round rear shoulder, on which a swash plate 13 is fixedly mounted, and front bifurcated respectively The bifurcated connecting portion 12*a* of the swash plate support 12 is connected to the aforementioned flattened connecting portion 7*c*, by sandwiching the portion 7*c* therebetween. A guide pin 14 fixedly fitted in the round bores 12*b* of the front bifurcated connecting portions 12*a* is arranged to pierce through the guide aperture 7*d*, to thereby maintain a contact thereof with the inner wall of the guide aperture 7*d* of the flattened connecting portion 7*c* of the drive shaft 7, whereby the rotation of the drive shaft 7 is transmitted to the swash plate 13 via the swash plate support 12. The contact between the guide pin 14 and the guide aperture 7*d* enables the swash plate 13 to be pivoted about a center "C" existing at the peripheral portion of the swash plate 13, in response to an axial sliding movement of the slide 10. Each of the double-headed pistons 6 is engaged with the periphery of the swash plate 13 via two spherical shoes 15 having a partial spherical surface, the center of which corresponds to the pivoting center "C" of the swash plate 13, and is reciprocated by the swash plate 13 in the associated front and rear cylinder bores 5*a* and 5*b* by the rotation of the swash plate 13.

The compressor is further provided with front and rear valve plates 16 and 17 arranged between the front and rear ends of the cylinder block 1 and the front and rear housings 3 and 4, and the front and rear housings 3 and 4 are provided with front and rear suction chambers 18 and 19, and front and rear discharge chambers 20 and 21, respectively. Each of the front and rear discharge chambers 20 and 21 is communicated with an external refrigerating circuit of an air-conditioning system via a discharge port (not shown) of the compressor. The front suction chamber 18 is communicated with the swash plate chamber 2 through a suction passageway 22 formed in the front cylinder block la, and the front compressing chambers Pf in the front cylinder bores 5*a* via a suction valve mechanism 23 provided for the front valve plate 16. The front discharge chamber 20 is communicated with the front compressing chambers Pf via a discharge valve mechanism 24. The rear suction chamber 19 is communicated with the swash plate chamber 2 via a suction passageway 25 formed in the rear cylinder block 1*b*, and the rear compressing chambers Pr in the rear cylinder bores 5*b* via a suction valve mechanism 26 provided for the rear valve plate 17. The rear discharge chamber 21 is communicated with the rear compressing chambers Pr via a rear discharge valve mechanism 27.

The front suction chamber 18 is communicated with a rear suction passageway 25 through a fluid passageway (or an external fluid conduit) 28 connecting between the front suction chamber 18 and an intermediate position of the rear suction passageway 25. Therefore, the front and rear suction chambers 18 and 19 are communicated with one another via the fluid passageway 28 and the rear suction passageway 25. Further, a tongue plate 29 is attached to the rear face of the swash plate 13 to be rotated with the swash plate chamber 12. The tongue plate 29 constitutes a suction reducing means capable of adjustably closing an opening end of the suction passageway 25 when approaching the opening end of the suction passageway 25. Namely, the tongue plate 29 acts as a sort of throttling plate, and is provided with a ring-shape portion 29*a* having a width larger than the diameter of the opening end of the suction passageway 25. Preferably, the tongue plate 29 having the ring-shape portion 29*a* is fixed to the swash plate 13 in such a manner that, when the front cylinder bores 5*a* of the front cylinder block 1*a* become substantially inactive or dormant due to the small capacity operation of the compressor, i.e., the compressor capacity is less than 30% of the full compressor capacity, the face of the ring-shape portion 29*a* approaches the opening end of the suction passageway 25 and closes that opening end in response to a movement of the swash plate 13 toward an erect position at which it exhibits the smallest inclination with respect to a plane vertical to the axis of rotation of the swash plate 13.

A control chamber 30 is arranged behind the rear suction chamber 19 of the rear housing 4 to be communicate with the rear suction chamber 19. The control chamber 30 is formed as a cylindrical chamber defined in the rear housing 4, and a slide controller 31 is arranged in the control chamber 30 to be axially slidably in constant contact with the rearmost end of the axial mover 8. This arrangement of the slide controller 31 permits a pressure in the control chamber 30 acting on the controller 31 to oppose a force for wobbling the swash plate 13, caused by a pressure in the front compressing chamber Pf, and a pressure in the rear compressing chamber Pr via the slide controller 31, the axial mover 8, and the swash plate 13.

The control chamber 30 is fluidly connected to a capacity control valve device 33 having a valve mechanism therein, via a fluid conduit 34. The capacity control valve device 33 is fluidly connected to the rear discharge chamber 21 via a fluid conduit 32*a*, and the swash plate chamber 2 via a fluid conduit 32*b*, and accordingly, when the valve mechanism of the capacity control valve device 33 is operated to close or open, the control chamber 30 is fluidly communicated with either the discharge chamber 21 in which a high discharge pressure prevails or the swash plate chamber 2 in which a low suction pressure prevails. Thus, the swash plate 13 can be moved to either a first position shown in FIG. 1 where the angle of inclination thereof with respect to the plane vertical to the axis of the drive shaft 7 becomes largest, or a second position shown in FIG. 2 where the angle of inclination thereof becomes smallest. Accordingly, the compressor capacity is adjustably varied.

The operation of the continuously variable capacity swash plate type compressor provided with the constitution and arrangement described hereinbefore will be described.

When the compressor is operated at the largest capacity state shown in FIG. 1, the swash plate 13 is rotated together with the drive shaft 7 about the axis of rotation thereof, and is also wobbled due to the inclined arrangement thereof, to reciprocate the double-headed pistons 6 in the front and rear cylinder bores 5*a* and 5*b* via the shoes 15. Therefore, a suction of a refrigerant gas from a suction pipe, which is a part of the external refrigerant circuit, is obtained to thereby introduce the refrigerant gas into the swash plate chamber 2 via an inlet port (not illustrated in FIGS. 1 and 2) of the compressor. The refrigerant gas is then sucked from the swash plate chamber 2 into the front and rear compressing chambers Pf and Pr through the front and rear suction passageways 22 and 25, and the front and rear suction chambers 18 and 19, to be compressed in both compressing chambers Pf and Pr of the front and rear cylinder bores 5*a* and 5*b*. The refrigerant gas after compression is subsequently discharged from the front and rear compressing chambers Pf and Pr toward the front and rear discharge chambers 20 and 21 via the front and rear discharge valve mechanisms 24 and 27, and is further delivered from the front and rear discharge chambers 20 and 21 toward the external refrigerant circuit via a discharge port and a discharge pipe which is a part of the external refrigerant circuit.

When the angle of inclination of the swash plate 13 is large, to thereby perform the large compressor capacity operation, since the tongue plate 29 attached to the swash plate 13 is located apart from the opening end of the rear suction passageway 25, the flow of the suction refrigerant gas is not affected by the tongue plate 29. Accordingly, the suction refrigerant gas flows smoothly from the swash plate chamber 2 into both of the front and rear suction chambers 18 and 19 while lubricating the radial bearings 9*a* and 9*c*, the thrust bearings 9*b* and 9*d*, and the lip seal 35 by lubricant oil suspended in the flowing refrigerant gas. Namely, such a flow of the refrigerant gas having the lubricant oil suspending therein can inertially and constantly reach and wet these movable elements. Further, during the large compressor capacity operation of the compressor, a control pressure necessary for providing the slide controller 31 with an accurate control movement is maintained at a considerably high level, and accordingly, the control movement of the slide controller 31 is accurate and stable and not influenced by factors such as a change in the suction gas pressure and a change in the number of rotations of the compressor, i.e., the number of rotations of the drive shaft 7. The slide movement of the slide controller 31 is smooth enough to obtain an accurate and minute control of the compressor capacity.

When the compressor is operated at a small compressor capacity, while maintaining the pressure of the control chamber 30 at a low level corresponding to the suction gas pressure, the angle of inclination of the swash plate 13 becomes small. When the inclination of the swash plate 13 is lessened to a state where the compressor capacity is approximately 30% of the full compressor capacity, the tongue plate 29 of the swash plate 13 is brought to the position shown in FIG. 2 and closes the opening end of the rear suction passageway 25. Since, in the compressor of the present embodiment, the top dead center of the pistons 6 during the compressing stroke thereof in the rear cylinder bores 5*b* is always set at a predetermined position within the rear compressing chambers Pr, the top dead center of the double-headed pistons 6 in the front cylinder bores 5*a* is necessarily displaced away from the front valve plate 16 in response to a decrease in the compressor capacity, i.e., a decrease in the extent of reciprocating stroke of the double-headed pistons 6, and accordingly, in each of the front cylinder bores 5, a substantial volume of the refrigerant gas that is not compressed by the pistons 6 is increased in response to a reduction in the compressor capacity. Thus, when the compressor capacity is reduced to 30% of the full compressor capacity, the front compressing chambers Pf of the front cylinder bores 5*a* become unable to perform a substantive suction and discharge of the refrigerant gas, i.e., the front compressing chambers Pf become inactive or dormant. When the front compressing chambers Pf of the front cylinder bores 5*a* become dormant, the pressure level in the front suction chamber 18 is identical to that in the swash plate chamber 2.

Figure 6:
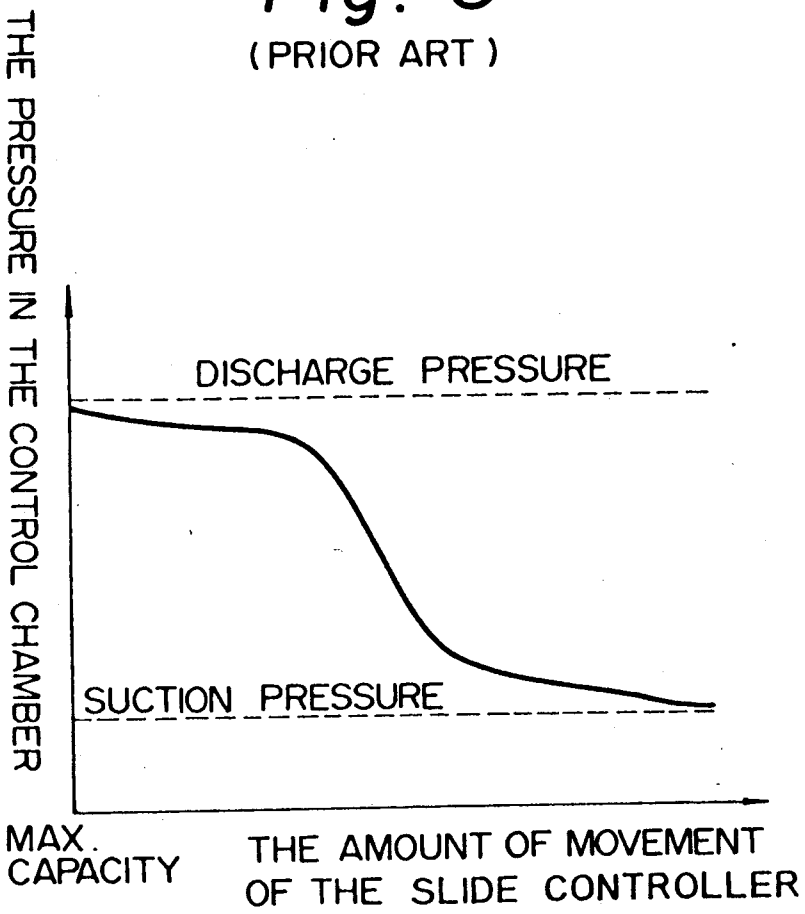
Fig. 6 (PRIOR ART)
FIG. 6 is a graphical view illustrating a relationship between the amount of movement of the slide controller and the pressure in the control chamber, with respect to the prior art.
Figure 3:
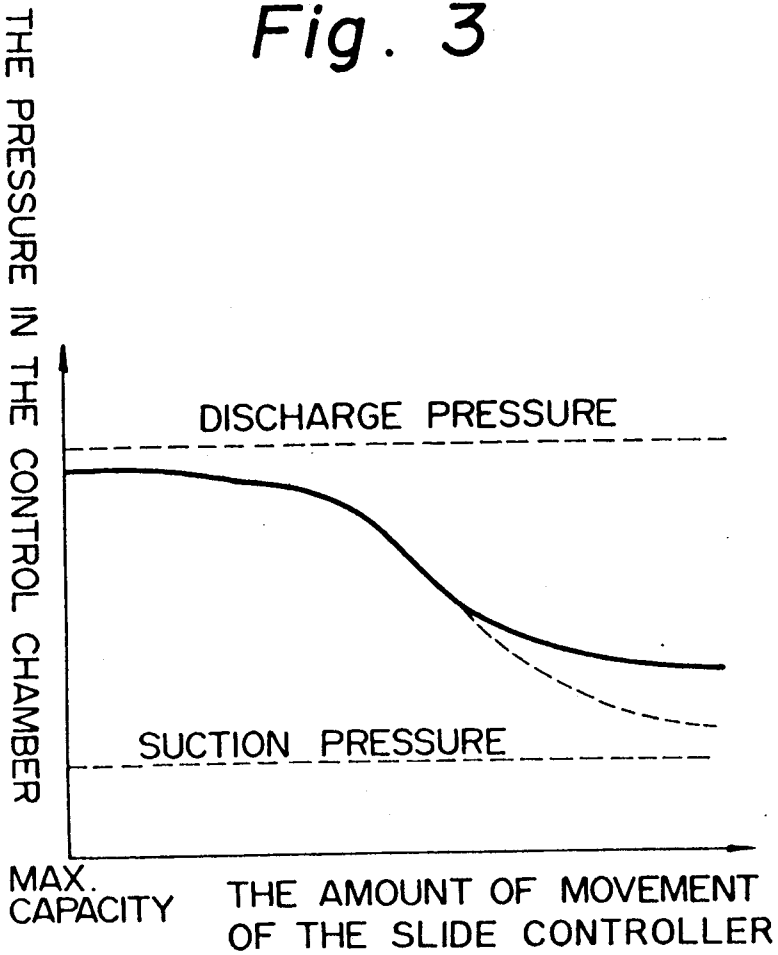
FIG. 3 is a graphical view illustrating a relationship between the amount of movement of the slide controller and the pressure in the control chamber of the compressor of FIG. 1.
Figure 5:
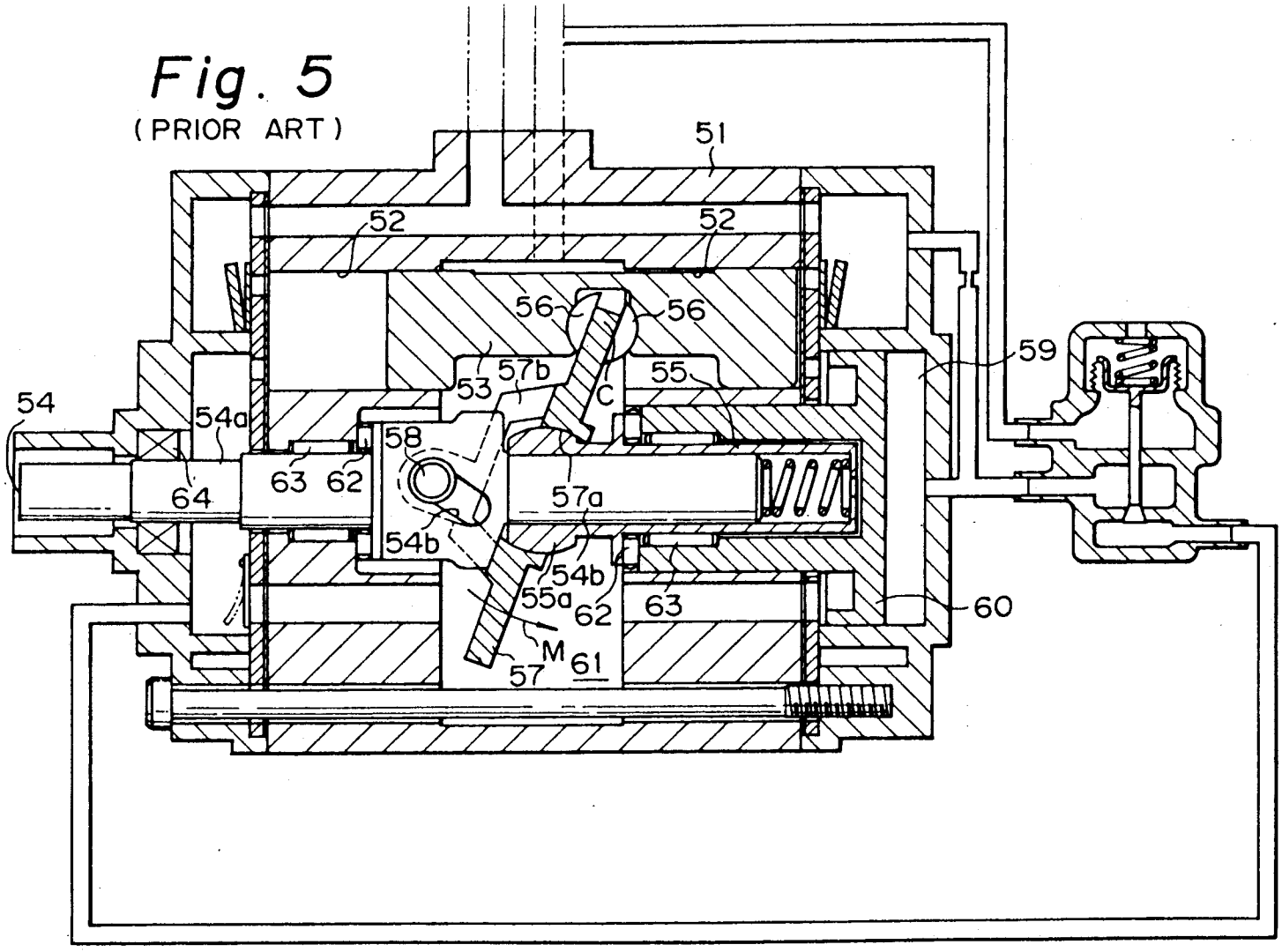
Fig. 5 (PRIOR ART)
FIG. 5 is a longitudinal cross-sectional view of a continuously variable capacity swash plate type compressor according to the prior art.

When the tongue plate 29 of the swash plate 13 is closes the opening end of the rear suction passageway 25, the pressure level in the rear suction chamber 19 becomes lower than that in the swash plate chamber 2, and accordingly, a pressure differential appears between the front and rear suction chambers 18 and 19. This pressure differential and the closing of the rear suction passageway 25 by the tongue plate 29 generate a flow of the refrigerant gas starting from the swash plate chamber 2 and arriving at the rear suction chamber 19, while passing through the thrust bearing 9*b*, the radial bearing 9*a*, the lip seal 35, the front suction chamber 18, and the fluid passageway 28. Thus, the flow of the refrigerant gas containing or suspending the lubricant oil therein is able to constantly lubricate the movable elements of the front side of the compressor even during the front compressing chambers Pf are dormant. Furthermore, when the rear suction passageway 25 is closed by the tongue plate 29, an average pressure of pressures generated in the respective rear cylinder bores 5*b* during the compressing operation of the double-headed pistons 6 in the rear compressing chambers Pr is lowered. Accordingly, a force pressing the slide controller 31 rearward via the double-headed pistons 6, the swash plate 13, the slide 10, and the axial mover 8 is made larger than when the rear suction passageway 25 is not closed by the tongue plate 29 of the swash plate 13. Therefore, the pressure necessary for controlling the slide movement of the slide controller 31 within the control chamber 30 during the small compressor capacity operation is larger than in the prior art variable capacity compressor shown in FIG. 5. Namely, as illustrated by a solid line in FIG. 3, a relationship between the amount of movement of the slide controller 31 and the pressure in the control chamber 30 is better than that of the prior art compressor as illustrated in FIG. 6. Note: for clarification, a dotted line in FIG. 3 indicates the relationship between the amount of movement of the slide controller and the pressure in the control chamber during the small compressor capacity operation of the prior art compressor not provided with a suction reducer unit, i.e., the tongue 29. From the curve of FIG. 3, it will be understood that the pressure necessary in the control chamber 30 for adjustably moving the slide controller 31 during the small compressor capacity operation can be large, and therefore, it is not affected by unfavourable factors such as a change in the suction pressure and a change in the number of rotations of the compressor. Namely, an enhancement of the controllability of the slide controller 31 during the small capacity operation of the compressor can be achieved. Moreover, since the control pressure in the control chamber 30 is maintained at a relatively high level even during the small capacity operation of the compressor, the movement of the slide controller 31 in the control chamber 30 can be smoothly and minutely controlled by the control pressure.

The constitution and arrangement of the continuously variable capacity swash plate type compressor according to the present invention is not limited to the afore-mentioned embodiment. For example, FIG. 4 illustrates a variation of the embodiment of FIGS. 1 and 2.

Figure 4:
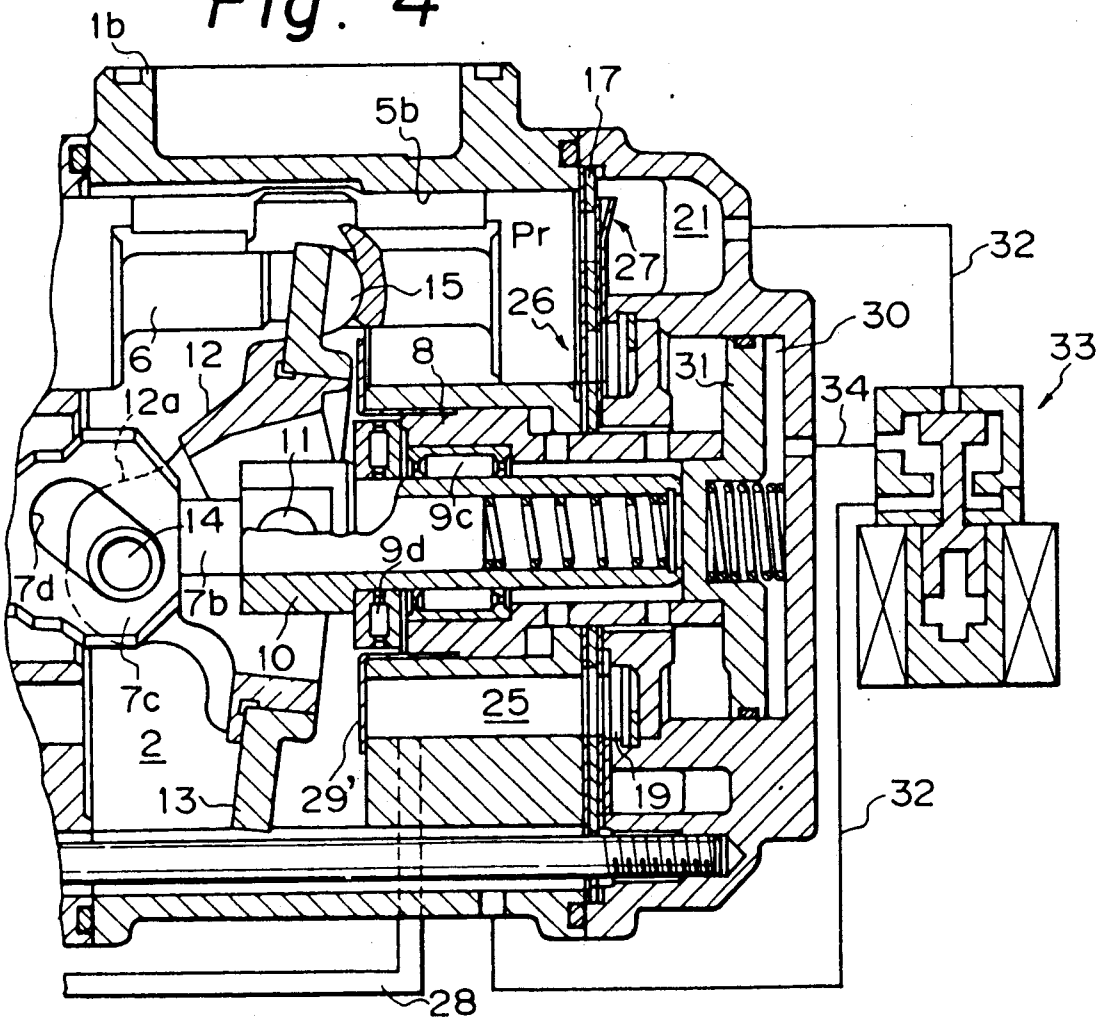
FIG. 4 is a partial cross-sectional view of the compressor, illustrating a variation of an important portion of the compressor of FIGS. 1 and 2.

Referring to FIG. 4, the compressor is provided with a suction reducer unit including a tongue plate 29' attached to the axial mover 8, to be thus moved together therewith.

Alternately, although not illustrated in the drawing, a valve mechanism as a suction reducer unit may be provided in the rear suction passageway 25 in such a manner that it opens or closes the passageway 25 during the small capacity operation of the compressor in response to a change in a pressure level in the control chamber 30. In a further variation, a solenoid valve unit may be arranged in the rear suction passageway to perform the duty ratio control.

It should be understood that the suction reducer according to the present invention may be arranged to partially close the rear suction passageway 25, if a pressure differential between the front and rear suction chambers 18 and 19 is generated, to obtain a constant flow of the refrigerant gas from the swash plate chamber 2 toward the rear suction chamber 19 through the front thrust bearing **9*b*, the front radial bearing 9*a*, the lip seal 35, the front suction chamber 18, and the fluid passageway or external conduit 28** during the small capacity operation of the continuously variable capacity swash plate type compressor.

From the foregoing description, it will be understood that, according to the present invention, the continuously variable capacity swash plate type compressor provided with a plurality of double-headed compressing pistons, a swash plate rotatable together with a compressor drive-shaft and capable of wobbling about a center "C" existing in the rear side of the compressor, and a slide controller capable of moving in a control chamber to control the angle of inclination of the swash plate with respect to a plane vertical to the axis of rotation of the drive shaft is able to smoothly vary the compressor capacity over the entire operating range of from a large to a small capacity operation, such as 30% of the full compressor capacity. Moreover, since a flow of the lubricant suspended refrigerant gas from the swash plate chamber toward the rear suction chamber while passing through the front suction chamber and the passageway connecting between the front and rear suction chambers is established, a constant lubrication of the movable elements, such as front radial and thrust bearings, is ensured by the lubricant even during a dormant state of the front cylinder bores.

We claim:

1. A continuously variable capacity swash plate type compressor for compressing a refrigerant gas used in a refrigerant circuit, comprising:

an axially extended cylinder block having front and rear ends thereof;

front and rear housings sealingly attached to the front and rear ends of the cylinder block and provided with front and rear suction chambers for the refrigerant before compression and front and rear discharge chambers for the refrigerant gas after compression;

a plurality of front and rear axial cylinder bores defined in front and rear portions of the axially extended cylinder block;

a plurality of double-headed pistons capable of axially reciprocating in the plurality of front and rear cylinder bores of the cylinder block to thereby compress the refrigerant gas;

an axial drive shaft rotatably supported in the cylinder block and having an axis of rotation thereof extending axially in the cylinder block;

a swash plate supported on the drive shaft to be integrally rotated with the drive shaft to reciprocate the double-headed pistons at front and rear parallel faces thereof, and shoes, the swash plate being pivotable to change an angle of inclination with respect to a plane vertical to the axis of rotation of the drive shaft about a center located at a peripheral portion of the swash plate which passes through each of the rear cylinder bores during a rotation of the swash plate, to thereby reciprocate each of the plurality of double-headed pistons in such a manner that a top dead center of each of the plurality of double-headed pistons is always located at a fixed position within each of the plurality of rear cylinder bores;

control means for controlling the angle of inclination of the swash plate to thereby adjustably vary the compressing capacity of the compressor depending on a change in a cooling load in the refrigerating circuit;

front suction passageway means arranged in the cylinder block for permitting a suction of the refrigerant gas before compression from the external refrigerating circuit into the front suction chamber;

rear suction passageway means arranged in the cylinder block for permitting a suction of the refrigerant gas before compression from the external refrigerating circuit into the rear suction chamber;

fluid passageway means for communicating between the front and rear suction chambers; and suction reducer means for reducing a flow of the refrigerant gas before compression passing through the rear suction passageway while the compressor is in operation at a small compressing capacity while the front cylinder bores are dormant, due to lessening of the angle of inclination of the swash plate, the suction reducer means being operable in association with a change in the compressing capacity of the compressor.

2. A continuously variable capacity swash plate type compressor according to claim 1, wherein said suction reducer means comprises a tongue plate attached to said swash plate, and provided with a plate portion capable of closing said rear suction passageway means in response to a pivoting of said swash plate toward a small inclination angle position thereof.

3. A continuously variable capacity swash plate type compressor according to claim 2, wherein said front and rear suction passageway means are provided, respectively, with an end opening toward a swash plate chamber defined in said cylinder block for housing said swash plate therein and receiving said refrigerant gas before compression from said external refrigerating circuit, and wherein said plate portion of said tongue plate closes said opening end of said rear suction passageway means.

4. A continuously variable capacity swash plate type compressor according to claim 1, wherein said suction reducer means comprises a tongue plate attached to a cylindrical mover of said control means, capable of axially moving with respect to said drive shaft to cause a change in said angle of inclination of said swash plate, said tongue plate being arranged to close said rear suction passageway means in response to a pivoting of said swash plate toward a small inclination angle position thereof.

5. A continuously variable capacity swash plate type compressor according to claim 1, wherein said fluid passageway means comprise an externally arranged fluid conduit running from said front suction chamber to said rear suction passageway means.

* * * * *

UNITED STATES PATENT AND TRADEMARK OFFICE

CERTIFICATE OF CORRECTION

PATENT NO. : 5,032,060

DATED : July 16, 1991

INVENTOR(S) : H. Kobayashi et al

It is certified that error appears in the above-identified patent and that said Letters Patent is hereby corrected as shown below:

Col. 5, line 46, after "bifurcated" insert --connecting portions 12a having a round bore 12b,--.

Col. 5, line 46, after "respectively" insert a --.-- .

Signed and Sealed this

Ninth Day of February, 1993

*Attest:*

STEPHEN G. KUNIN

*Attesting Officer*

*Acting Commissioner of Patents and Trademarks*